US007182407B1

(12) United States Patent
Peach et al.

(10) Patent No.: US 7,182,407 B1
(45) **Date of Patent: *Feb. 27, 2007**

(54) ROCK BORING DEVICE WITH AN OSCILLATING AND NUTATING ROTARY DISC CUTTER

(75) Inventors: Anthony John Peach, Tasmania (AU); Alwyn Arthur Jones, Tasmania (AU); Anton Josep Jurasovic, Tasmania (AU); Geoffrey Peter Johnstone, Tasmania (AU); Wayne Anthony Cusick, Tasmania (AU); David Burnett Sugden, Tasmania (AU)

(73) Assignee: Odyssey Technology Pty Ltd, Queensland (AU)

( * ) Notice: Subject to any disclaimer, the term of this patent is extended or adjusted under 35 U.S.C. 154(b) by 0 days.
n This patent is subject to a terminal disclaimer.

(21) Appl. No.: 09/889,745

(22) PCT Filed: Jan. 20, 2000

(86) PCT No.: PCT/AU00/00030

§ 371 (c)(1),
(2), (4) Date: Oct. 15, 2001

(87) PCT Pub. No.: WO00/43637

PCT Pub. Date: Jul. 27, 2000

(30) Foreign Application Priority Data

Jan. 20, 1999 (AU) ..... PP8224

(51) Int. Cl.
*E21C 25/16* (2006.01)

(52) U.S. Cl. ..... 299/75

(58) Field of Classification Search ..... 299/1.05, 299/1.4–1.6, 1.8, 36.1, 37.1, 39.1, 42, 51, 299/52, 73–78, 58, 85.1; 175/398, 343, 351, 175/56; 409/200; 83/647.5
See application file for complete search history.

(56) References Cited

U.S. PATENT DOCUMENTS

| | | | | |
|---|---|---|---|---|
| 1,634,322 | A | 7/1927 | Dornes, Jr. | |
| 2,336,335 | A * | 12/1943 | Xublin | 175/378 |
| 3,429,390 | A * | 2/1969 | Bennett | 175/343 |
| 3,663,054 | A * | 5/1972 | Dubois | 299/18 |
| 4,005,905 | A | 2/1977 | Dubois | |

(Continued)

FOREIGN PATENT DOCUMENTS

| | | |
|---|---|---|
| AU | 18912/70 | 2/1972 |

(Continued)

OTHER PUBLICATIONS

Reference Materials Describing and/or Showing Rolling Type Cutters and Other Cutters (pp. 193-195, 198-201), undated.
Encyclopedia of Mining, Tunnelling and Drilling Equipment, 11 pages (unnumbered), undated.

*Primary Examiner*—Sunil Singh

(74) *Attorney, Agent, or Firm*—Nixon & Vanderhye P.C.

(57) ABSTRACT

A rock boring device (10) including a rotary disc cutter (11). The disc cutter (11) is driven in an oscillating manner and also driven or free to nutate, and the device includes a mounting section (22) for the rotary disc cutter and a driven section (21), and wherein the mounting section (22) is angularly offset from the axis of the driven section whereby the rotary disc cutter will both oscillate and nutate.

47 Claims, 5 Drawing Sheets

U.S. PATENT DOCUMENTS

| | | | | | |
|---|---|---|---|---|---|
| 4,096,917 | A | * | 6/1978 | Harris | 175/228 |
| 4,168,755 | A | | 9/1979 | Willis | |
| 4,169,629 | A | | 10/1979 | Legrand | |
| 4,245,939 | A | | 1/1981 | Sear | |
| 4,261,425 | A | * | 4/1981 | Bodine | 175/106 |
| 4,273,383 | A | | 6/1981 | Grisebach | |
| 4,341,273 | A | * | 7/1982 | Walker et al. | 175/339 |
| 4,372,403 | A | | 2/1983 | Beeman | |
| 4,417,379 | A | * | 11/1983 | Goode | 29/35.5 |
| 4,527,637 | A | * | 7/1985 | Bodine | 175/55 |
| 4,796,713 | A | * | 1/1989 | Bechem et al. | 175/96 |
| 5,103,705 | A | | 4/1992 | Bechem | |
| 5,575,537 | A | | 11/1996 | Kogler et al. | |
| 6,062,650 | A | * | 5/2000 | Smith et al. | 299/1.4 |
| 6,076,895 | A | | 6/2000 | Ino et al. | |
| 6,357,831 | B1 | * | 3/2002 | Stoebe | 299/75 |
| 6,561,590 | B2 | | 5/2003 | Sugden | |

FOREIGN PATENT DOCUMENTS

| | | | |
|---|---|---|---|
| AU | 41965/72 | | 12/1973 |
| CA | 2080828 | | 6/1998 |
| DE | 4332113 | | 3/1995 |
| EP | 692612 | | 1/1996 |
| GB | 2124407 | | 2/1984 |
| GB | 2136479 | | 9/1984 |
| GB | 2252576 | | 8/1992 |
| SU | 581263 | | 11/1977 |
| SU | 714008 | | 2/1980 |
| SU | 1084438 | | 4/1984 |
| SU | 2363841 | | 10/1986 |
| WO | WO 91/18185 | | 11/1991 |
| WO | WO 00/46486 | * | 8/2000 |

* cited by examiner

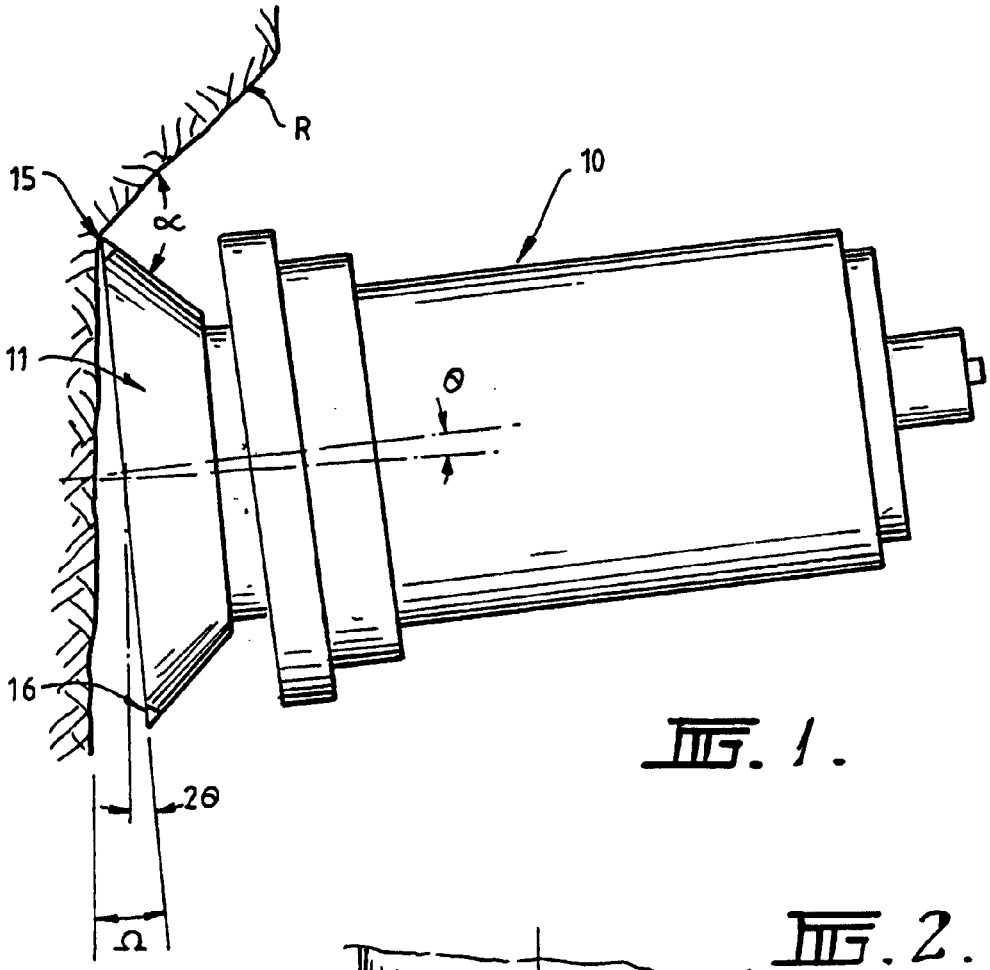
FIG. 1.
FIG. 2.
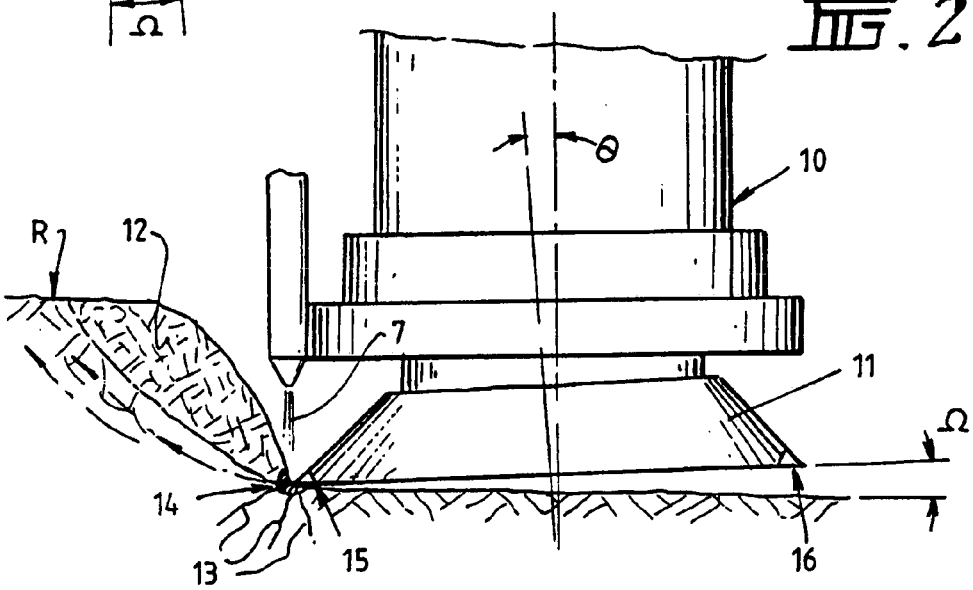

ROCK BORING DEVICE WITH AN OSCILLATING AND NUTATING ROTARY DISC CUTTER

CROSS-REFERENCE TO PRIORITY APPLICATION

This is a national phase application of PCT/AU00/00030, filed Jan. 20, 2000, pending, which claims the benefit of Australian Patent Application, No. PP 8224, filed Jan. 20, 1999, each incorporated herein by reference in its entirety.

TECHNICAL FIELD

The present invention relates to a boring device for creating bore holes in rock, or removing rock from a surface. (For example the floor of a quarry).

BACKGROUND ART

Boring of holes in rock faces can be conducted in a variety of ways. For example, explosive boring, as the name suggests, involves drilling in the rock face a central primary hole and a series of secondary holes about the primary hole. The secondary holes have a diameter suitable to receive an explosive charge, while the primary holes provides an opening in the rock towards which cracks that are formed in the rock after detonation of the explosive, can propagate. The primary hole is normally of a greater diameter than the secondary holes. Cracks that propagate from the secondary holes to the primary hole create rock chips or segments, that can be separated from the rock being bored and which are thereafter removed, leaving behind a bore hole. The size of the bore hole required determines the number of primary and secondary holes needed, while each explosive detonation can only remove a certain amount of rock, so that the above process may have to be repeated several times to form a bore hole of sufficient cross section and length. As can easily be appreciated this method of boring can be quite dangerous due to the use of explosive material, while it is also time consuming and complicated to prepare the primary and secondary holes in the rock face. Additionally detonation of the explosives is a skilful exercise, as each explosive is detonated separately and at different times, to achieve the greatest extent of crack propagation.

A different form of rock boring involves the use of roller cutters that are rotationally forced into impact with the rock to again create cracks that propagate through the rock. The roller cutters employ a plurality of cutting tips, arranged at a variety of different diameters, which are forced into engagement with the rock surface adjacent one another, so that cracks are formed by one cutting tip propagate and intersect with cracks formed by an adjacent tip, thus created a rock chip or segment that can be separated from the rock under the impact of the roller cutter. Applying immense compressive forces to the rock creates the cracks, and eventually a balancing tensile failure occurs. Boring devices of this kind are subject to extensive impact loading because the cutting tips are forced into engagement with the rock under large loads in order to generate the cracks in the rock and thus the rock boring device is required to have facility for large impact absorption. The impact absorption is provided by way of a huge absorption mass attached to the device and the mass is of such a size, that known boring devices can weigh many hundreds of tonnes, a substantial component of which is for impact absorption. As a consequence, the weight and size of these devices makes them expensive to construct and operate.

DISCLOSURE OF THE INVENTION

It is an object of the following invention to overcome, or at least reduce one or more of the disadvantages associated with prior art boring devices. It is a further object of the invention to provide a mechanical device of a rotary cutting type, that provides improved rock removal from a rock face to form a rock bore and which is relatively economical to manufacture and operate. The cross section of this bore may be circular, or a polygon, or a planar surface. (Longwall in Coal or a quarry floor).

A rock boring device according to the present invention includes a rotary disc cutter, that in use, is either inserted into a pilot opening formed in the rock face, or approaches the rock face at an angle to enable entry.

For this cutting action to be initiated the tip of the disc should initially contact the rock at significant angle. (Probably in excess of 45°, but differing rock types or conditions may reduce or increase this requirement).

The boring device is characterised in that the disc cutter is driven in an oscillating manner, and also driven to nutate or free to nutate. The disc cutter is driven to move in this manner about separate or combined oscillating and nutating axes. The nutation angle may be varied or fixed from 0° to almost 90° (Most probably less than 5°). That motion, when applied to the rock face, will cause the disc cutter to apply force to the rock that promotes cracks which propagate toward the rock face adjacent the opening. By this mechanism rock fragments or chips can be separated from the rock when a crack propagates from the wall of the opening to the adjacent rock face. The crack will propagate from a pressure bulb created by the motion of the oscillation, nutation or combination of both motions. This cutting action enables the rock to fail in tension rather than the current traditional compressive first then tension technique. This phenomenon significantly reduces the supporting structure mass for the proposed technology. To insure that the cutting mechanism does not move away from the rock being cut, rather than cut the rock, a mass surrounding the cutter may be necessary.

BRIEF DESCRIPTION OF THE DRAWINGS

Several preferred embodiments of the invention will now be described with reference to the accompanying drawings, in which:

FIG. 1 is a schematic view of the rock boring device of the preferred embodiment of the present invention and showing the manner in which it makes contact with a rock face, FIG. 2 is also a schematic view of the rock, boring device showing the manner in which it acts to remove rock material.

BEST MODES FOR CARRYING OUT THE INVENTION

Figure 3:
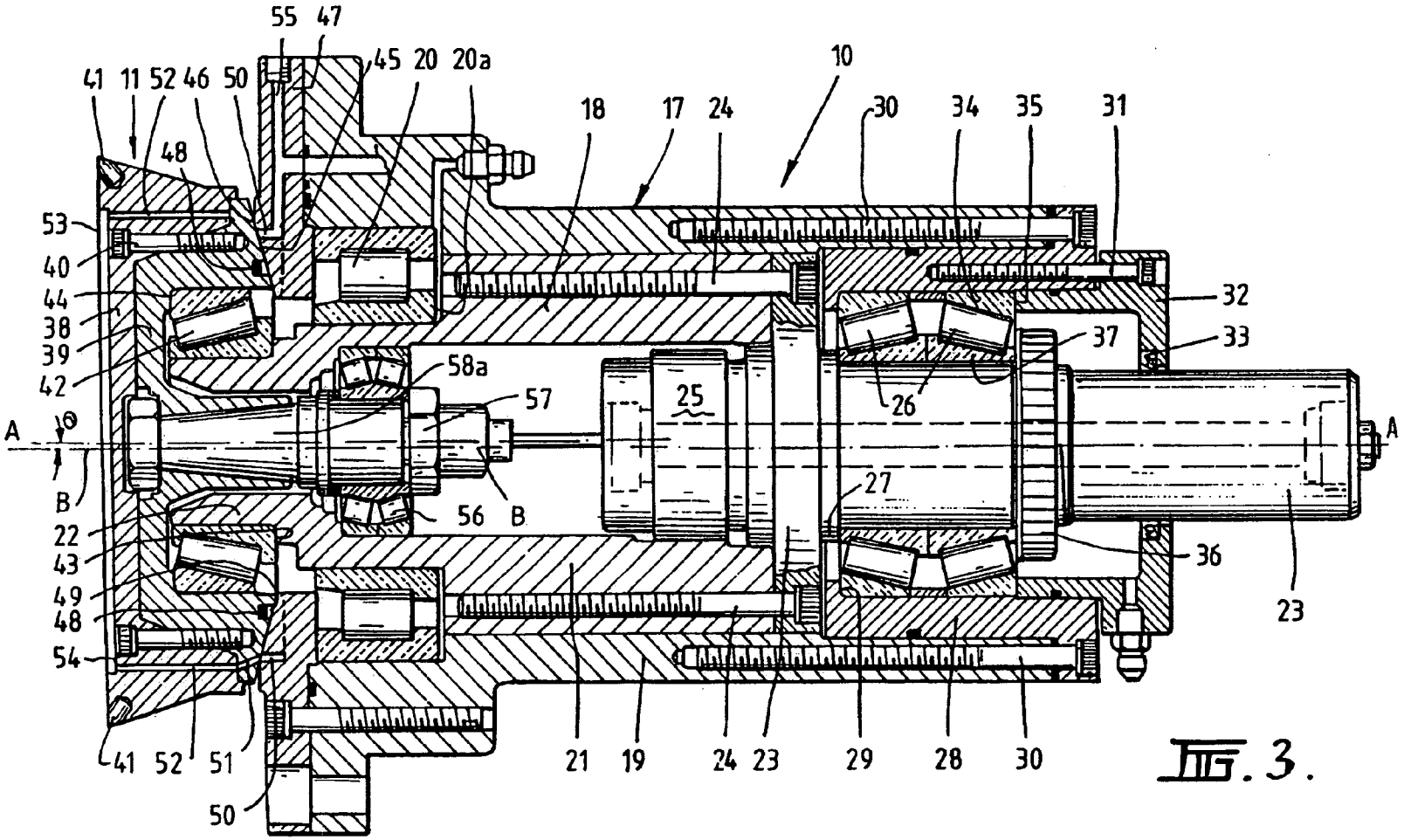
FIG. 3 is a detailed cross-sectional side elevational view of the rock boring device.

With reference to FIGS. 1 and 2 of the drawings, the rock boring device 10 according to this preferred embodiment of the present invention includes a rotary disc cutter 11, that in use, is either inserted into a pilot opening formed in the rock face R, or approaches the rock face at an angle ($\alpha$) to enable entry (see FIG. 1).

For this cutting action to be initiated the tip of the disc should initially contact the rock at significant angle. (Probably in excess of 45°, [$\alpha$] but differing rock types or conditions may reduce or increase this requirement).

The boring device 10 is characterised in that the disc cutter 11 is driven in an oscillating manner, and also driven to nutate or is free to nutate. The disc cutter 11 is driven to move in this manner about separate or combined oscillating and nutating axes. The nutation angle ($\theta$) may be varied or fixed from 0° to almost 90° (Most probably less than 5°). That motion, when applied to the rock face, will cause the disc cutter to apply force to the rock that promotes cracks which propagate toward the rock face adjacent the opening (see FIG. 2). By this mechanism rock fragments or chips 12 can be separated from the rock when a crack 13 propagates from the wall of the opening to the adjacent rock face. The crack will propagate from a pressure bulb 14 created by the motion of the oscillation, nutation or combination of both motions. This cutting action enables the rock to fail in tension rather than the current traditional compressive first then tension technique. This phenomenon significantly reduces the supporting structure mass for the proposed technology.

Advantageously, the nutating motion of the disc cutter also lends to promote separation of the rock segments from the rock face and may assist sharpening of the contact point of the rotatably mounted disc. Because the disc is rotatably mounted, during each oscillation, the disc will precess. This action provides a new portion of the consumable portion of the disc to the rock and also will assist to distribute the temperature created due to the interaction of the disc and the rock. The cutting action of the tip 15 of the disc will require that the heel 16 of the disc does not contact the rock. To accomplish this a positive 'rake' angle ($\Omega$) must be achieved. This angle may be fixed or varied depending upon the operational mechanism. This angle may also be varied depending upon the rock type of characteristics. The variables being monitored by assessment of the forces within the drive mechanism and surrounding support structure, and the results applied to algorithms in an allied computer control system. Depending upon the result of the interpretation of the data, the computer can act to alter angle $\omega$ by providing a suitable signal to a electro-mechanical actuator that can provide the require force to alter the angle of the disc during the cutting action.

A rock boring device according to the invention principally will bore a groove in the rock at circa the diameter of the disc, and at the depth of plunge into the rock. The cutter excavates the rock by generating cracks in the rock and separating rock segments formed by the cracks. However, rock normally will also be removed by the abrasive action of the cutting tips against the rock and the nutating motion of the disc cutter against the rock will also facilitate removal of rock in this manner. However, the amount of rock removed by this mechanism is relatively small. This rock is in the zone referred to previously as the pressure bulb 14.

Currently the pressure bulb area or disc to rock contact zone is cooled and airborne dust is controlled by the addition of low pressure water (Less than 10 Bar) applied through the disc via a series of holes. This coolant could also be applied from an external source so that it is directed to contact the tip of the disc area. It may be possible to increase the performance of the system by directing high-pressure water (Probably above 200 Bar) at the pressure bulb area. This jet could be applied either perpendicular to the direction of travel, or in line with the axis of travel, or any angle in between. The water jet indicated as 7 in FIG. 2 may enter the crack that is propagating from the pressure bulb and apply a force in equal and all directions, thereby forcing the rock chip to break to the free air side.

The disc cutter of the boring device preferably has a circular, rock engaging periphery, and may include a plurality of cutting tips which are removably connected to the cutter, but could be permanently connected. Preferably, those tips extend from the disc cuter at or adjacent to the circular periphery thereof either radially, axially, or in a combination of both. The cutting tips can be formed of any suitable material, abrasion resistant, with inherent toughness such as tungsten carbide, alloy and hardened steel, possibly ceramic or other, depending on the type of rock being bored. They can also have any suitable shape and can be fixed to the disc cutter in any suitable manner. The cutter may also be contiguous and be produced of any or a combination of the materials mentioned.

The oscillating movement of the disc cutter can be generated in any suitable manner. This motion may be direct mechanical means, or by poly-phase hydraulic pump and motor combination.

With reference to FIG. 3 of the drawings the cutting device 10 includes a mounting assembly 17 as well as the rotary disc cutter 11. The mounting assembly 17 includes a mounting shaft 18 which is rotatably mounted within a housing 19, that can constitute or be connected to a large mass for impact absorption. The housing 19 thus, can be formed of heavy metal or can be connected to a heavy metallic mass. The shaft 18 is mounted within the housing 19 by a bearing 20, which can be of any suitable type and capacity. The bearing 20 is mounted in any suitable manner known to a person skilled in the art, such as against a stepped section 21.

The housing 19 can have any suitable construction, and in one form includes a plurality of metal plates fixed together longitudinally of the shaft 18. With one such arrangement, the applicant has found that a plurality of iron and lead plates provides effective impact absorption based on weight and cost considerations.

The shaft 18 is mounted for rotating motion about a central longitudinal axis AA. The shaft 18 includes a driven section 21 and a mounting section 22. The driven section 21 is connected to drive means 23 at the end thereof remote from the mounting section by any suitable connectors, such as heavy duty threaded fasteners 24, while a seal 25 is applied between the facing surfaces of the mounting section and the drive means.

The drive means 23 can take any suitable form and the means shown in FIG. 3 is a shaft that may be driven by a suitable engine or motor. The drive means 23 is mounted within the housing 19 by bearings 26, which are tapered roller bearings, although other types of bearings, either anti friction, plain hydrostatic, or hydrodynamic, that provide radial and axial force reaction could also be employed. With one typical arrangement, the bearings 26 are mounted against a stepped section 27 of the drive means 23 and against a mount insert 28 which is also stepped at 29. The mount insert 28 is fixed by threaded connectors 30 to the housing 19, and fixed to the mount insert 28 by further threaded connectors 31 is a sealing cap 32 which seals against the drive means 23 by seals 33. The sealing cap 32 also locates the outer race 34 of the bearings 26 by engagement therewith at 35, while a threaded ring 36 locates the inner race 37.

The mounting section 22 is provided for mounting of the disc cutter 11 and is angularly offset from the axis AA of the driven section 21, which generally will be approximately normal to the rock face being excavated. The axis BB of the mounting section 22 is shown in FIG. 3 and it can be seen that the offset angle θ is in the order of a few degrees only. The magnitude of the offset angle θ determines the size of the oscillating and nutating movements of the disc cutter 11 and the angle θ can be arranged as appropriate. The angle θ could be zero, but the axis of the eccentric section off-set from the AA axis (FIG. 3). This would provide oscillation but no nutation.

The disc cutter 11 includes an outer cutting disc 38 that is mounted on a mounting head 39 by suitable connecting means, such as threaded connectors 40. The outer cutting disc 38 could include a plurality of tungsten carbide cutting bits 41 which are fitted to the cutting disc matrix in any suitable manner. Alternatively, a tungsten carbide ring could be employed. The outer cutting disc can be removed from the cutting device for replacement or reconditioning, by removing the connectors 40.

The disc cutter 11 is rotatably mounted on the mounting section 22 of the mounting shaft 18. The disc cutter 11 is mounted by a tapered roller bearing 42, that is located by a step 43 and a wall 44 of the mounting head 39. An inclined surface 45 of the mounting head 39 is disposed closely adjacent a surface 46 of a mounting insert 47. The surfaces 45 and 46 are spaced apart with minimum clearance to allow relative rotating movement therebetween and the surfaces have a spherical curvature, the centre of which is at the intersection of the axes AA and BB.

A seal 48 is located in a recess 49 of the surface 45 to seal against leakage of lubricating fluid from between the mounting shaft 18, and the housing 19 and the disc cutter 11. A channel 50 is also provided in the surface 45 outwardly of the seal 48 and ducts 51 connect the channel 50 to a further channel 52 and a further duct 53 extends from the channel 52 to a front surface 54 of the outer cutting disc 38. Pressurised fluid can be injected into the various channels and ducts through the port 55 and that fluid is used to flush the underside of the cutting disc 38 as well as the relative sliding surfaces 45 and 46.

The disc cutter 11 is rotatably mounted to the mounting section 22 of the mounting shaft 18 by the tapered roller bearing 42 and by a further tapered roller bearing 56. The bearing 56 is far smaller than the bearing 42 for the reason that the large bearing 42 is aligned directly in the load path of the disc cutter and thus is subject to the majority of the cutter load. The smaller bearing 56 is provided to pre-load the bearing 42.

The bearing 56 is mounted against the inner surface of the mounting shaft 18 and the outer surface of a bearing loading facility, comprising a nut 57 and a pre-loading shaft 58. Removal of the outer cutting disc 38 provides access to the nut 57 for adjusting the pre-load of the bearing 56.

The nutating movement of the disc cutter 11, occurs simultaneously with the oscillating motion and that nutating movement is movement in which a point on the cutting edge of the disc cutter is caused to move sinusoidally, in a cyclic or continuous manner as the disc cutter rotates. This movement of the disc cutter applies an impact load to the rock surface under attack, that causes tensile failure of the rock.

The direction of impact of the disc cutter against the rock under face is reacted through the bearing 42 and the direction of the reaction force is substantially along a line extending through the bearing 42 and the smaller bearing 56.

The boring device of the invention is not restricted to a single disc cutter, but can include more than one. For example, the boring device may include three disc cutters arranged along the same plane, but at approximately 45° to each other. Such an arrangement can produce a bore of a particular shape, while the speed at which rock is removed is greatly increased. In this arrangement, each of the three disc cutters can be driven by the one drive means, or they may be driven by separate drive means.

Figure 4:
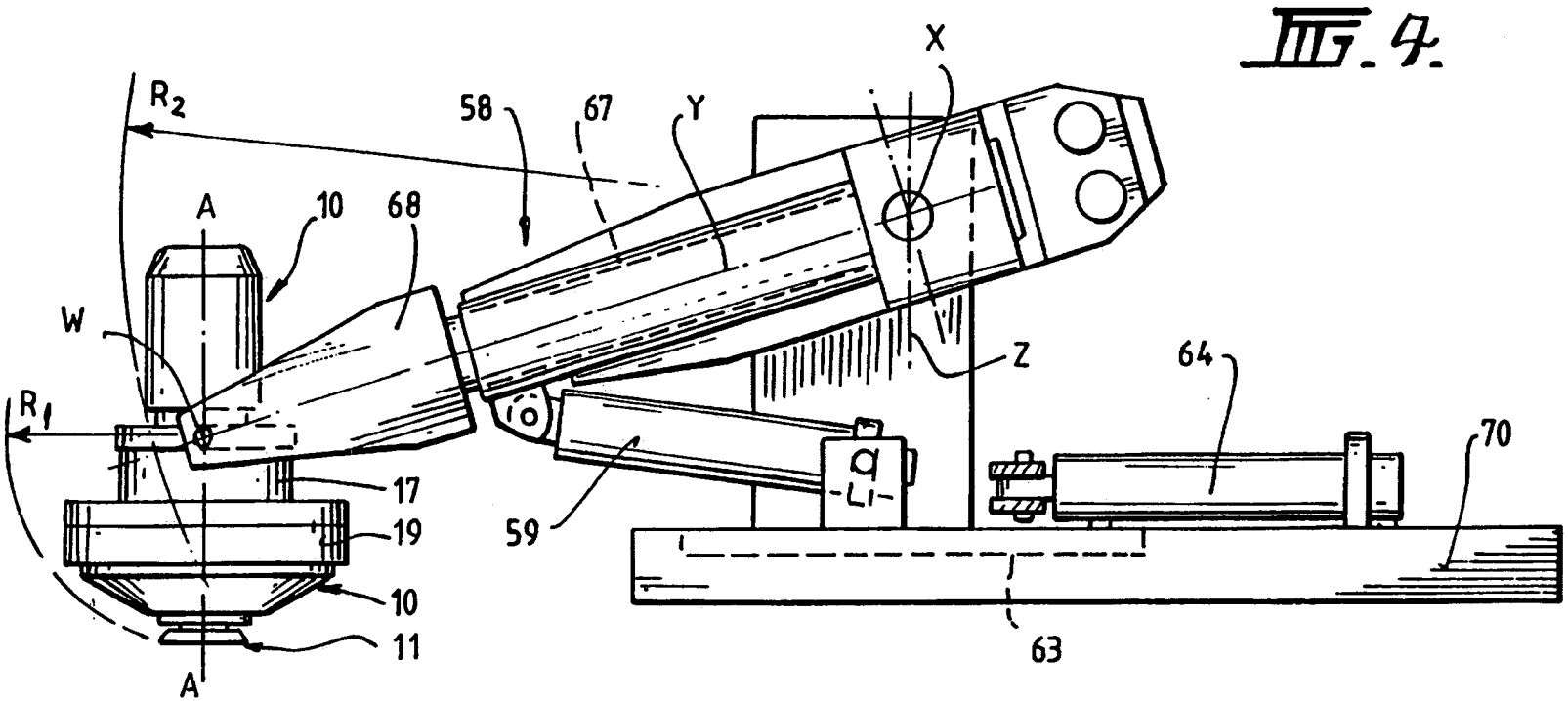
FIG. 4 is a schematic side elevational view of one example of how the device may be machine mounted to achieve the creation of a bore hole.
Figure 5:
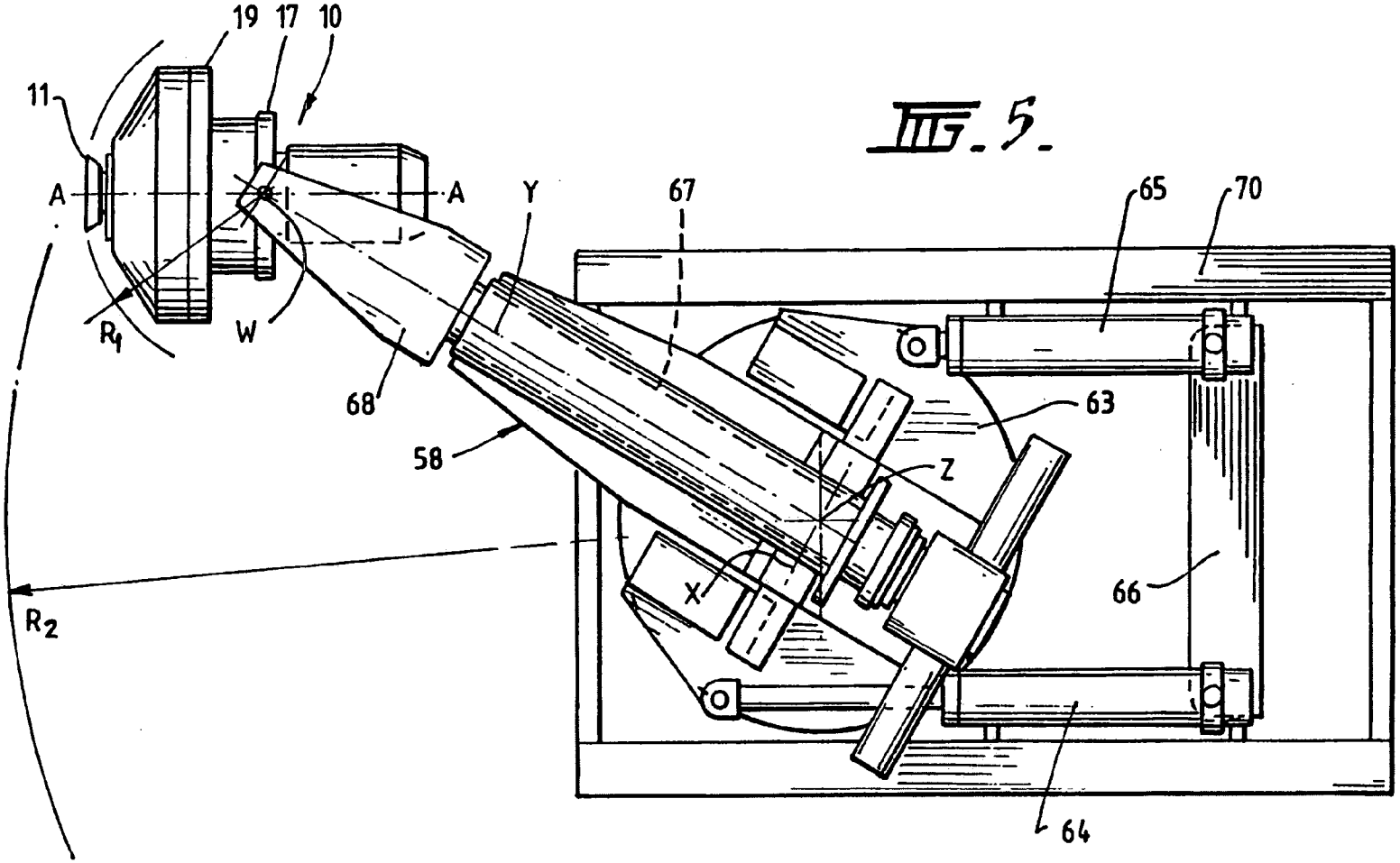
FIG. 5 is a plan view of the machine mounted device of FIG. 4.

Alternatively with reference to FIGS. 4 and 5 the cutting device 10 may be mounted on a moveable boom 58 to enable the disc cutter 11 to be moved about the pilot opening as that opening is enlarged. In this arrangement the housing, and impact absorption mass (if provided) may also be mounted on the boom. The boom may be elevated by an actuator 59 to tilt about a horizontal axis X and pivotable laterally via a turntable 63 about a vertical axis Z by extension and retraction of a pair of rams 64 and 65 extending from cradle 66 to either side of the turntable 63 and mounted on a chassis 70. The boom 58 has shaft 67 therethrough which in turn carries a connector 68 to which the cutting device 11 is pivotably connected at W. The shaft 67 can rotate about its longitudinal axis Y. As a consequence of the pivot axes W, X, Y and Z, the cutting device can be positioned through a whole range of orientations including over one arc dictated by a short radius $R_1$ about pivot axis W and an arc dictated by a larger radius $R_2$ about pivot axes X and Z. The entire assembly would be anchored by a clamping means. This may be by vertical anchoring, horizontal anchoring or by application of a mass or adhesive mechanism to ensure the entire vehicle is in a finite position prior to commencing the first cut. Subsequent cuts at the rock face must be referenced to the previous cut to ensure a predetermined depth of cut is maintained. To increase the depth of cut beyond the design limit will cause the surrounding mechanism to engage the rock and stall or cease the cutting action.

This indexing and the geometry to cut the face can be composed by computer control in order to provide appropriate speed of operation.

Figure 6:
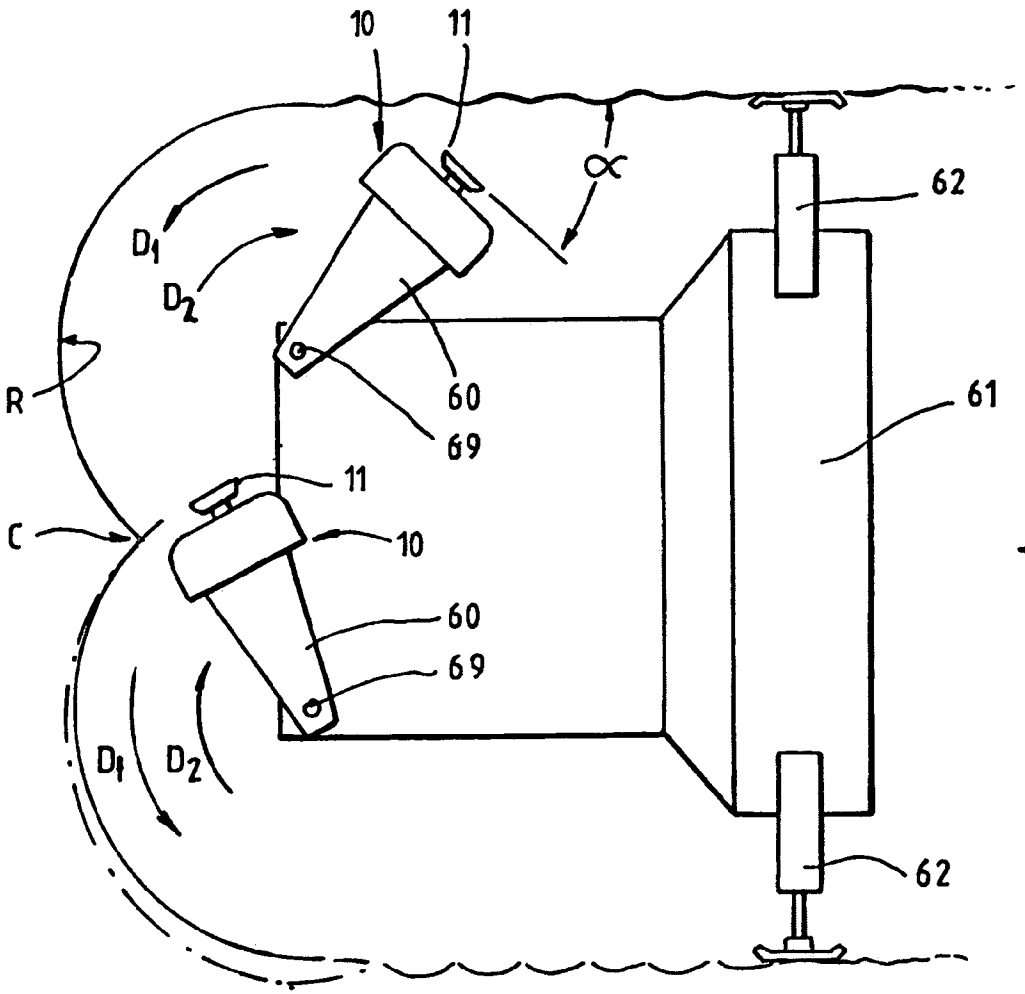
FIG. 6 is a schematic view of another example of how the device may be machine mounted to achieve the creation of a bore hole.

With reference to FIG. 6 of the drawings, in a still further arrangement, a pair of boring devices 10 may be mounted on separate booms 60 and the disc cutters are swept in an arc across the rock face and about pivot points 69, to continually remove successive layers of rock from the face. The entire machine platform 61 must be securely anchored within the bore by gripping mechanisms 62.

The disc cutters of each device is arranged to sweep in an arc across the rock face being excavated in a first direction $D_1$ and having completed that sweep, return in the reverse direction $D_2$, with each sweep of the disc cutters removing a layer of the rock face. Entrance of the disc cutters into the rock for each successive pass, may be at the cusp C between adjacent concave sections formed by the sweep of each disc cutter.

The complete machine for the purpose of excavating a tunnel should be mobile and may be mounted on a crawler or on wheels. Providing the carrier or supporting vehicle will fit into the hole size selected, the opening in the rock can be from completely circular at the minimum end of the cutting shape spectrum, to somewhat ovoid. However most customers currently prefer to have a flat floor to enable them to operate subsequent vehicles.

The invention claimed is:

1. A rock boring device comprising:

a boom having a proximal end and a distal end, the proximal end being pivotable about a first boom axis, wherein said boom is rotatable about a longitudinal axis of the boom;

a disc cutter pivotably mounted to the distal end of the boom to pivot about a wrist axis and structured to engage a rock face; and an inertial reaction mass to stabilize the disc cutter; wherein said disc cutter is structured to be driven in an oscillating manner and movable in a nutating manner, the disc cutter configured to oscillate about an oscillation axis that is substantially perpendicular to the wrist axis, said disc cutter including a substantially continuous, circumferential cutting edge defining a leading tip and a trailing heel, the leading tip of the disc cutter being movable along a path that is substantially parallel to the rock face and substantially perpendicular to the oscillation axis to effect rock boring, the trailing heel of the disc cutter being spaced from said rock face during cutting.

2. A rock boring device as claimed in claim 1, wherein said disc cutter is free to rotate.

3. A rock boring device as claimed in claim 1, wherein said rock boring device includes a shaft comprising a driven section configured to rotate about a longitudinal rotation axis and a mounting section for mounting said disc cutter to said shaft on a mounting axis, and wherein said mounting axis is offset from the rotation axis of said driven section whereby said disc cutter will oscillate.

4. A rock boring device as claimed in claim 3 wherein said mounting axis is angularly offset from the rotation axis of said driven section by an angle greater than 0° and less than 10° whereby the disc cutter will nutate.

5. A rock boring device as claimed in claim 3, wherein said mounting axis is angularly offset from the axis of said driven section by an angle greater than 0° and less than 90° whereby said disc cutter will nutate.

6. A rock boring device as claimed in claim 1, wherein said first boom axis is substantially vertical.

7. A rock boring device according to claim 1, wherein said disc cutter is driven in said nutating manner.

8. A rock boring device according to claim 1, wherein said disc cutter is driven in said oscillating manner and is free to nutate.

9. A rock boring device according to claim 1, wherein the cutting edge includes a plurality of cutting tips that are removably connected to the disc cutter.

10. A rock boring device according to claim 1, wherein the cutting edge includes a plurality of cutting tips that are permanently connected to or formed as part of the disc cutter.

11. A rock boring device according to claim 1, wherein the cutting edge includes a plurality of bits.

12. A rock boring device according to claim 1, wherein the cutting edge comprises a substantially continuous cutting ring.

13. A rock boring device according to claim 1, wherein the inertial reaction mass is annular and substantially surrounds the disc cutter.

14. A rock boring device as claimed in claim 1, wherein:

the boom is structured to pivot about the first boom axis to allow global pivoting of the combined boom and disc cutter, and the disc cutter and the inertial reaction mass are structured to pivot about the wrist axis to allow local wrist-like pivoting movement of the disc cutter and the inertial reaction mass with respect to the distal end of the boom.

15. A rock boring device as claimed in claim 14, wherein the disc cutter is structured to pivot about the wrist axis in a first direction and the boom is structured to pivot about the first boom axis in a second direction, wherein the first and second directions are substantially the same just before the disc cutter engages the rock face.

16. A rock boring device as claimed in claim 1, wherein the inertial reaction mass is structured, in use, to counteract an impact force created upon impact with the rock face.

17. A rock boring device according to claim 1, further including a shaft comprising a mounting section for mounting the disc cutter, the mounting section including a primary bearing substantially aligned with a load path of the disc cutter and a secondary bearing provided to preload the primary bearing.

18. A rock boring device according to claim 17, wherein a reaction force created by engagement of the rock face is substantially along the line extending through the primary and secondary bearings.

19. A rock boring device as claimed in claim 1, wherein a linear cutting velocity of said rotary disc cutter is controlled by interaction with a computer that processes algorithms with variable information input being provided by strain gauges and accelerometers mounted adjacent to said rotary disc cutter.

20. A rock boring device as claimed in claim 1, including means to reference the position of the machine with respect to the rock face, thereby allowing a predetermined depth of cut to be maintained at said rock face throughout a cutting cycle.

21. A rock boring device as claimed in claim 1, wherein the disc cutter is structured to move in a direction substantially along the rock face just before impacting a ledge protruding away from the rock face.

22. A rock boring device as claimed in claim 21, wherein the inertial reaction mass is structured, in use, to counteract an impact force created upon impact with the ledge.

23. A rock boring device as claimed in claim 1, wherein said boom is pivotable about a second boom axis at the proximal end, said second boom axis disposed generally orthogonal to said first boom axis.

24. A rock boring device as claimed in claim 1, wherein said first boom axis is substantially horizontal.

25. A rock boring device comprising:

a disc cutter structured to engage a rock face and an inertial reaction mass to stabilize the disc cutter; wherein said disc cutter is mounted on a shaft including a driven section having a first axis of rotation and a mounting section that supports the disc cutter for relative rotation about a second axis of rotation that is offset from the first axis of rotation, so that the disc cutter is driveable in an oscillating manner and movable in a nutating manner; and a boom to support the disc cutter, said boom being pivotable about a first boom axis so as to translate the disc cutter along a path that is generally parallel to the rock face, the disc cutter being mounted on said boom to pivot about a second boom axis that is substantially perpendicular with the first axis of the driven section, the disc cutter being maintained at a proper attitude relative to the rock face by pivoting of the disc cutter about the second boom axis in a direction that is opposite to a direction in which the boom pivots about the first boom axis during cutting, said disc cutter defining a substantially continuous circumferential cutting edge, wherein the boom is structured to pivot about the first boom axis to allow global pivoting of the combined boom and disc cutter, the boom is rotatable about a longitudinal axis of said boom, and the disc cutter and the inertial reaction mass are structured to pivot about the second boom axis to allow local wrist-like pivoting movement of the disc cutter and the inertial reaction mass with respect to a distal end of the boom.

26. A rock boring device according to claim 25, wherein the disc cutter includes a tip to engage the rock face and a heel positioned opposite said tip, wherein the tip and heel of the disc cutter define with the rock face a non-zero rake angle such that the heel is positioned to avoid contact with the rock face.

27. A rock boring device according to claim 25, wherein the cutting edge includes a substantially continuous cutting ring formed on a larger diameter portion of a conic section.

28. A rock boring device according to claim 25, wherein the inertial reaction mass substantially surrounds the disc cutter and includes a plurality of stacked iron and lead plates coupled to pivot with the disc cutter about said second boom axis.

29. A rock boring device comprising:

a disc cutter for engaging a rock face, said disc cutter including a substantially continuous, circumferential cutting edge positioned at a periphery of the disc cutter, wherein said disc cutter is arranged for nutation and rock cutting oscillation about an oscillation axis;

an inertial reaction mass to stabilize the disc cutter, said reaction mass being relatively large compared to the disc cutter, such that in operation, reactive cutting forces exerted by the rock face on the disc cutter in a generally radial direction are transmitted to and resisted by the inertial reaction mass thereby stabilizing the disc cutter during rock cutting;

a boom structured to pivot about a first boom axis to allow global pivoting of the combined boom and disc cutter, wherein the boom is rotatable about a longitudinal axis of said boom that is substantially transverse to or perpendicular to the first boom axis, and the disc cutter and the inertial reaction mass are structured to pivot about a second boom axis to allow local wrist-like pivoting movement of the disc cutter and the inertial reaction mass with respect to a distal end of the boom.

30. A rock boring device according to claim 29, wherein the inertial reaction mass is annular and substantially surrounds the disc cutter.

31. A rock boring device according to claim 29, wherein the cutting edge includes a substantially continuous cutting ring formed on a larger diameter portion of a conic section.

32. A rock boring device according to claim 29, wherein the oscillation axis is substantially normal to the disc.

33. A rock boring device as claimed in claim 29, wherein said disc cutter is free to rotate.

34. A rock boring device as claimed in claim 29, wherein said rock boring device includes a shaft comprising a driven section configured to rotate about a longitudinal rotation axis and a mounting section for mounting said disc cutter to said shaft on a mounting axis, and wherein said mounting axis is offset from the rotation axis of said driven section whereby said disc cutter will oscillate.

35. A rock boring device as claimed in claim 34, wherein said mounting axis is angularly offset from the rotation axis of said driven section by an angle greater than 0° and less than 10° whereby the disc cutter will oscillate.

36. A rock boring device according to claim 29, wherein said disc cutter is driven in said nutating manner.

37. A rock boring device according to claim 29, wherein the disc cutter includes a tip to engage the rock face and heel positioned opposite said tip, wherein the tip and heel of the disc cutter define with ground a non-zero rake angle such that the heel is positioned to avoid contact with the rock face.

38. A rock boring device according to claim 37, wherein the rake angle is variable.

39. A rock boring device according to claim 29, further comprising a mounting section for the disc cutter, the mounting section including a primary bearing substantially aligned with a load path of the disc cutter and a secondary bearing provided to preload the primary bearing.

40. A rock boring device according to claim 29, wherein a reaction force created by engagement of the rock face is substantially along the line extending through the primary and secondary bearings.

41. A rock boring device as claimed in claim 29, wherein a linear cutting velocity of said rotary disc cutter is controlled by interaction with a computer that processes algorithms with variable information input being provided by strain gauges and accelerometers mounted adjacent to said rotary disc cutter.

42. A rock boring device as claimed in claim 29, including means to reference the position of the machine with respect to the rock face, thereby allowing a predetermined depth of cut to be maintained at said rock face throughout a cutting cycle.

43. The rock boring device as claimed in claim 42, wherein said machine is anchored with respect to said rock face thereby allowing a predetermined depth of cut to be maintained at said rock face throughout a cutting cycle.

44. A rock boring device as claimed in claim 29, wherein the first boom axis to allow global pivoting of the combined boom and disc cutter; and the disc cutter is structured to pivot about a second boom axis is substantially perpendicular or transverse to the first boom axis.

45. A rock boring device as claimed in claim 44, wherein the disc cutter is structured to pivot about the second boom axis in a first direction and the boom is structured to pivot about the first boom axis in a second direction, wherein the first and second directions are substantially the same just before the disc cutter engages the rock face.

46. A rock boring device as claimed in claim 29, wherein the disc cutter is structured to move in a direction substantially along the rock face just before impacting a ledge protruding away from the rock face.

47. A rock boring device as claimed in claim 46, wherein the inertial reaction mass is structured, in use, to counteract an impact force created upon impact with the ledge.

* * * * *